US010801149B2

(12) United States Patent
Chun et al.

(10) Patent No.: US 10,801,149 B2
(45) Date of Patent: Oct. 13, 2020

(54) WASHING MACHINE

(71) Applicant: SAMSUNG ELECTRONICS CO., LTD., Suwon-si, Gyeonggi-do (KR)

(72) Inventors: Kwang Min Chun, Suwon-si (KR); Jong Woon Park, Hwaseong-si (KR); Seon Ho Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 203 days.

(21) Appl. No.: 15/850,475

(22) Filed: Dec. 21, 2017

(65) Prior Publication Data

US 2019/0071809 A1 Mar. 7, 2019

(30) Foreign Application Priority Data

Sep. 7, 2017 (KR) ..... 10-2017-0114262

(51) Int. Cl.

| | |
|---|---|
| ***D06F 29/02*** | (2006.01) |
| ***D06F 37/06*** | (2006.01) |
| ***D06F 37/18*** | (2006.01) |
| ***D06F 37/22*** | (2006.01) |
| ***D06F 37/34*** | (2006.01) |
| ***D06F 37/30*** | (2020.01) |
| ***D06F 37/40*** | (2006.01) |
| ***D06F 39/02*** | (2006.01) |

(Continued)

(52) U.S. Cl.

CPC ..... *D06F 29/02* (2013.01); *D06F 23/06* (2013.01); *D06F 31/00* (2013.01); *D06F 37/06* (2013.01); *D06F 37/18* (2013.01); *D06F 37/22* (2013.01); *D06F 37/24* (2013.01); *D06F 37/262* (2013.01); *D06F 37/269* (2013.01); *D06F 37/304* (2013.01); *D06F 37/40* (2013.01); *D06F 39/02* (2013.01); *D06F 39/04* (2013.01); *D06F 39/085* (2013.01); *D06F 39/088* (2013.01); *D06F 39/14* (2013.01); *D06F 23/02* (2013.01); *D06F 23/04* (2013.01); *D06F 34/28* (2020.02); *D06F 39/12* (2013.01)

(58) Field of Classification Search

CPC ..... D06F 29/02; D06F 31/00; D06F 37/18; D06F 37/22; D06F 37/24; D06F 37/304; D06F 37/40; D06F 39/02; D06F 39/04; D06F 39/085; D06F 39/088; D06F 39/14; D06F 37/262; D06F 37/06; D06F 37/269; D06F 23/04; D06F 39/005; D06F 39/12; D06F 23/02

See application file for complete search history.

(56) References Cited

U.S. PATENT DOCUMENTS

2005/0081576 A1* 4/2005 Park ..... D06F 29/00 68/20
2009/0133197 A1* 5/2009 Lee ..... D06F 31/00 8/158

(Continued)

*Primary Examiner* — Benjamin L Osterhout
(74) *Attorney, Agent, or Firm* — Staas & Halsey LLP

(57) ABSTRACT

A washing machine including a first tub accommodated in a housing and formed by assembling a first member disposed in the front portion with a second member disposed in the rear portion; a second tub disposed above the first tub, a drum rotatably disposed in the inside of the second tub; and a driving shaft connected to the drum, configured to transfer a driving force to the drum and located further behind than an engaged portion of the first member and the second member of the first tub.

17 Claims, 9 Drawing Sheets

(51) Int. Cl.

| | |
|---|---|
| ***D06F 39/04*** | (2006.01) |
| ***D06F 39/08*** | (2006.01) |
| ***D06F 39/14*** | (2006.01) |
| ***D06F 23/06*** | (2006.01) |
| ***D06F 23/04*** | (2006.01) |
| ***D06F 39/00*** | (2020.01) |
| ***D06F 37/26*** | (2006.01) |
| ***D06F 37/24*** | (2006.01) |
| ***D06F 31/00*** | (2006.01) |
| *D06F 23/02* | (2006.01) |
| *D06F 39/12* | (2006.01) |
| *D06F 34/28* | (2020.01) |

(56) References Cited

U.S. PATENT DOCUMENTS

2010/0058817 A1 3/2010 Yoshikawa et al.
2010/0269266 A1* 10/2010 Lee ..... D06F 29/00 8/159
2011/0265524 A1* 11/2011 Kim ..... D06F 29/00 68/13 R
2012/0042697 A1* 2/2012 Hong ..... D06F 33/02 68/12.23
2012/0060566 A1* 3/2012 Kim ..... D06F 25/00 68/140
2016/0032514 A1* 2/2016 Won ..... D06F 37/268 68/27
2016/0215432 A1* 7/2016 Kim ..... D06F 37/203
2017/0356115 A1* 12/2017 Choi ..... D06F 33/02

* cited by examiner

WASHING MACHINE

CROSS-REFERENCE TO RELATED APPLICATION

This application claims the benefit of Korean Patent Application No. 10-2017-0114262, filed on Sep. 7, 2017 in the Korean Intellectual Property Office, the disclosure of which is incorporated herein by reference.

BACKGROUND

1. Field

Embodiments of the present disclosure relate to a washing machine, and more particularly, to a washing machine including a plurality of washing apparatuses.

2. Description of the Related Art

In general, a washing machine is an apparatus for washing laundry by rotating a rotation tub in the shape of a cylinder in which laundry is contained. Washing machines are classified into a washing machine in which a rotation tub is disposed horizontally so that when the rotation tub rotates with respect to a horizontal shaft, laundry rises upward along the inner circumferential surface of the rotation tub and then falls to thereby be washed, and a washing machine in which a rotation tub having a pulsator therein is disposed vertically so that when the rotation tub rotates with respect to a vertical shaft, laundry is washed by a water current generated by the pulsator.

The washing machine in which the rotation tub is disposed horizontally is called a front loading washing machine since a laundry entrance is formed in the front portion, and the washing machine in which the rotation tub is disposed vertically is called a top loading washing machine since a laundry entrance is formed in the upper portion.

Meanwhile, since a typical washing machine has a single washing apparatus, a user who wants to sort laundry and wash the laundry separately should drive the washing machine two times or more. Accordingly, the user had to drive the washing machine for a long time even when washing a small amount of laundry.

SUMMARY

Therefore, it is an aspect of the present disclosure to provide a washing machine having a plurality of washing apparatuses.

It is another aspect of the present disclosure to provide a washing machine having a structure for efficiently using an inside space of a housing and improving a user's convenience.

Additional aspects of the disclosure will be set forth in part in the description which follows and, in part, will be obvious from the description, or may be learned by practice of the disclosure.

In accordance with one aspect of the present disclosure, a washing machine may include a housing; a first tub accommodated in the housing, including a first opening through which laundry is put, in the front portion, and formed by assembling a first member disposed in the front portion with a second member disposed in the rear portion; a second tub accommodated in the housing, and including a second opening through which laundry is put, in the upper portion; a first drum rotatably disposed in the inside of the first tub;

a second drum rotatably disposed in the inside of the second tub; and a driving shaft connected to the second drum, and configured to transfer a driving force to the second drum, the driving shaft penetrating the second tub. The second tub may be disposed above the first tub, and the driving shaft is located further behind than an engaged portion of the first member and the second member of the first tub.

The first tub may be inclined downward from the front portion to the rear portion. The engaged portion of the first tub may protrude from a side surface of the first tub. The driving shaft may protrude below the second tub.

A distance from a lowermost end of the housing to a center of a rear surface of the first drum may be 0.3 times or more of a distance from the lowermost end of the housing to an uppermost end of the housing.

A distance from a lowermost end of the housing to a center of a rear surface of the first drum may be 0.5 times or less of a distance from the lowermost end of the housing to an uppermost end of the housing.

The housing may include a door configured to open or close the second opening. An uppermost end of the housing may be an uppermost end of the door.

In accordance with one aspect of the present disclosure, a washing machine may include a housing; a first tub disposed in the housing, and configured to store water; a first drum rotatably disposed in the inside of the first tub; a second tub disposed above the first tub in the housing, and configured to store water; a second drum rotatably disposed in the inside of the second tub; and a driving shaft connected to the second drum, and configured to transfer a driving force to the second drum. The first tub may be inclined downward from the front portion to the rear portion. The driving shaft may protrude below the second tub.

The first tub may be formed by assembling a first member disposed in the front portion with a second member disposed in the rear portion. The driving shaft may be located further behind than an engaged portion of the first member and the second member of the first tub.

A distance from a lowermost end of the housing to a center of a rear surface of the first drum may be 0.3 times or more of a distance from the lowermost end of the housing to an uppermost end of the housing.

A distance from a lowermost end of the housing to a center of a rear surface of the first drum may be 0.5 times or less of a distance from the lowermost end of the housing to an uppermost end of the housing.

The housing may include a second opening through which laundry is put into the inside of the second drum, and a door configured to open or close the second opening. The uppermost end of the housing may be the uppermost end of the door.

In accordance with one aspect of the present disclosure, a washing machine may include a first housing whose upper portion opens; a first tub disposed in the first housing, and configured to store water; a first drum rotatably disposed in the first tub; a second housing coupled with an upper portion of the first housing, wherein a lower portion of the second housing opens; a second tub disposed in the second housing, and configured to store water; a second drum rotatably disposed in the second tub; and a driving shaft connected to the second drum, and configured to provide a driving force to the second drum, the driving shaft penetrating the second tub. The first housing may include a first opening through which laundry is put into the inside of the first drum from front. The second housing may include a second opening through which laundry is put into the inside of the second drum from above. The first tub may be formed by assembling a first member disposed in the front portion with a second member disposed in the rear portion, the first tub inclined downward from the front portion to the rear portion. The driving shaft may be located further behind than the engaged portion of the first member and the second member of the first tub.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
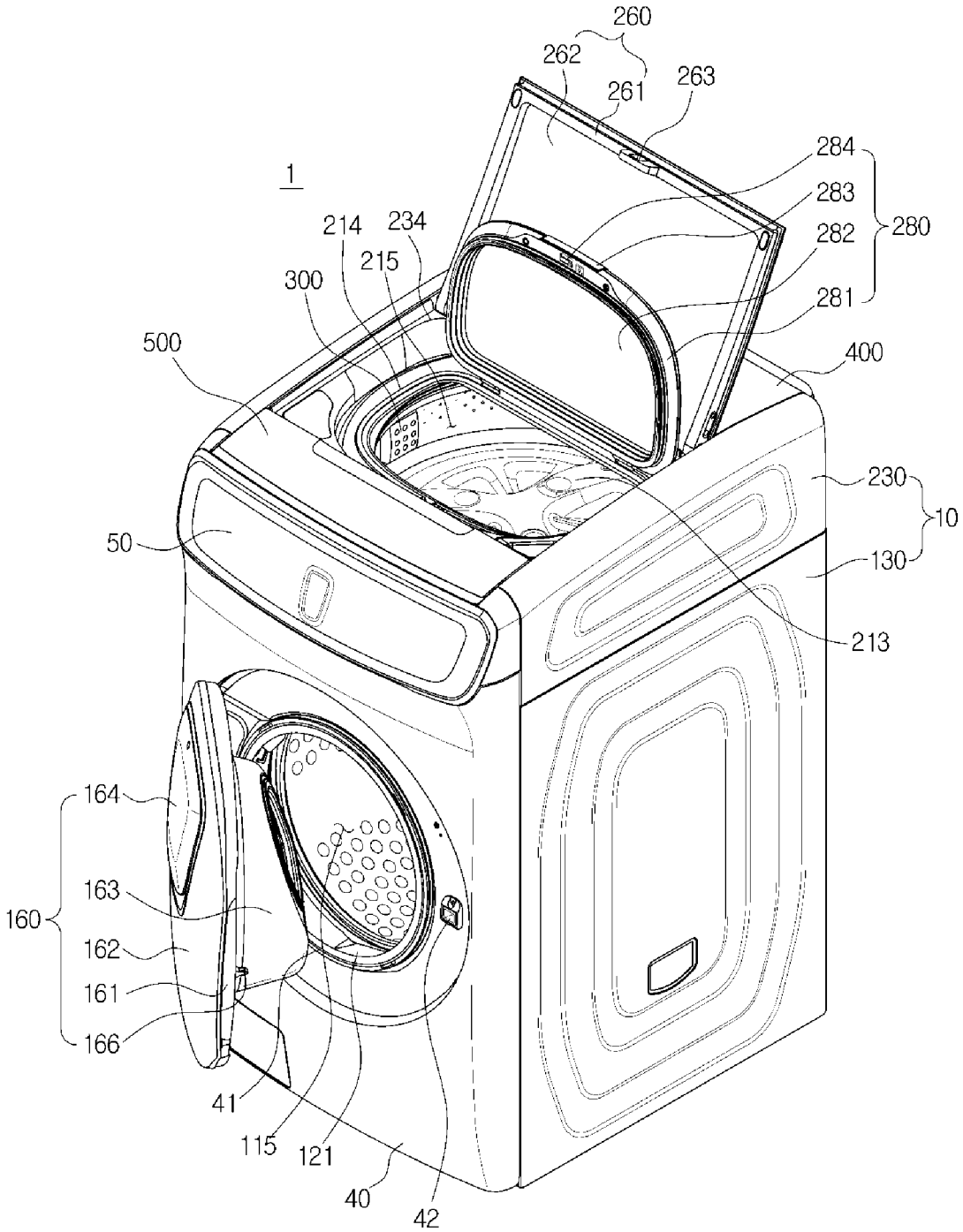
FIG. 1 is a perspective view of a washing machine according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, the embodiments of the present disclosure will be described in detail with reference to the accompanying drawings.

Figure 2:
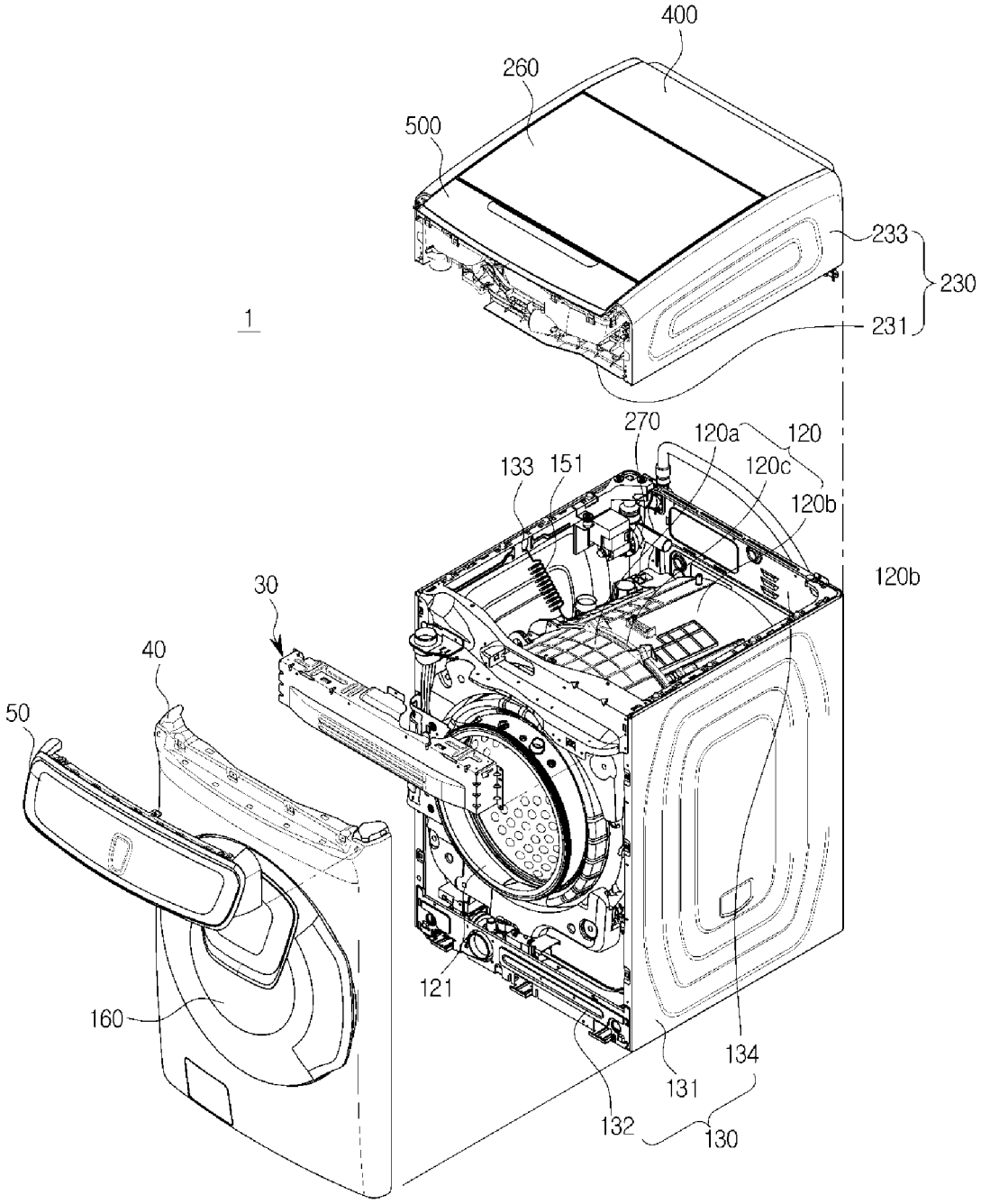
FIG. 2 is an exploded perspective view of a part of the washing machine shown in FIG. 1.
Figure 3:
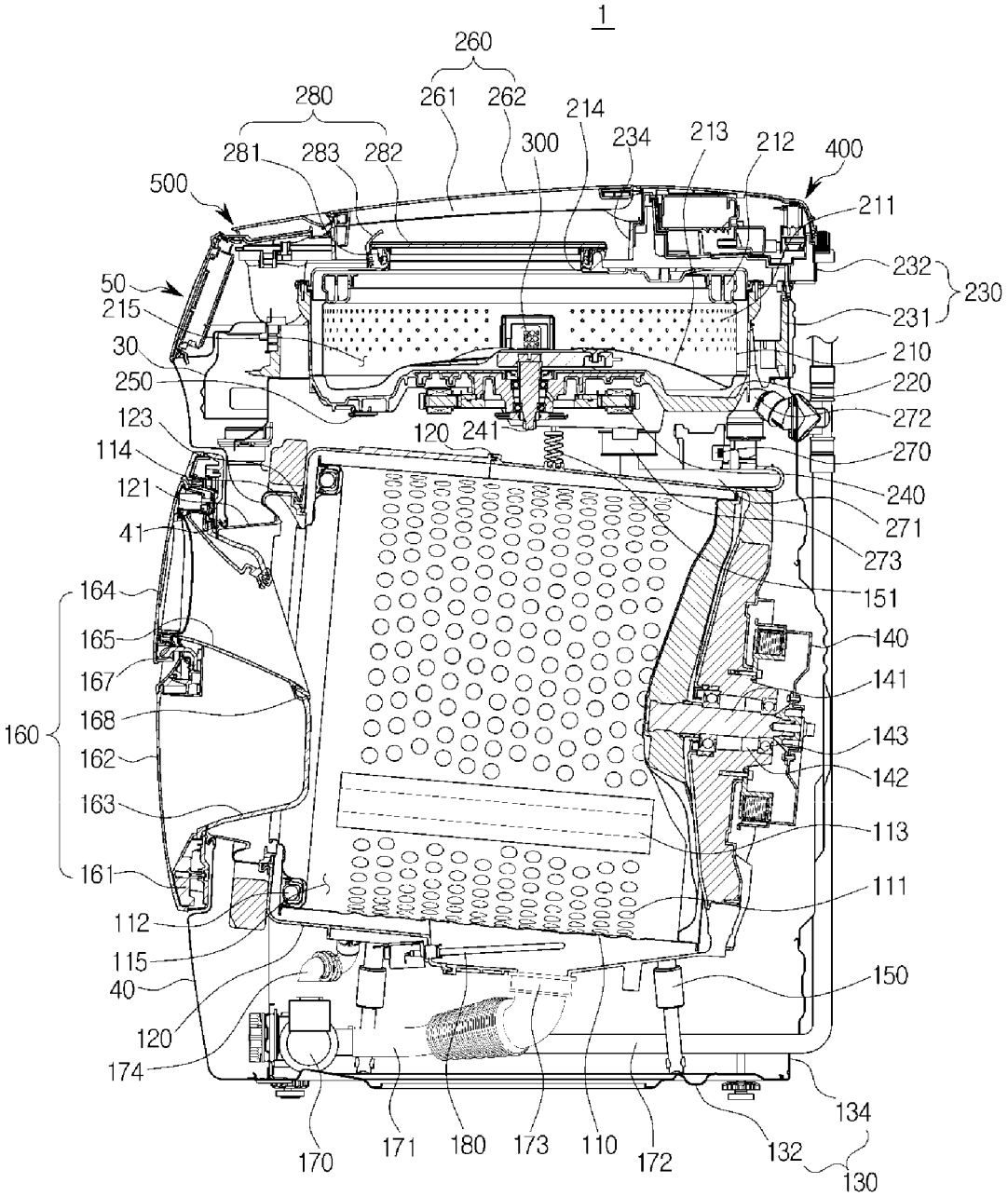
FIG. 3 is a cross-sectional view of the washing machine shown in FIG. 1.

FIG. 1 is a perspective view of a washing machine according to an embodiment of the present disclosure, FIG. 2 is an exploded perspective view of a part of the washing machine shown in FIG. 1, and FIG. 3 is a cross-sectional view of the washing machine shown in FIG. 1.

As shown in FIGS. 1, 2, and 3, a washing machine 1 may include a first washing apparatus of a front loading type in which a laundry entrance is formed in front of a first washing space 115, and a second washing apparatus of a top loading type in which a laundry entrance is formed above a second washing space 215.

The washing machine 1 may include a first drum 110 forming the first washing space 115 therein, and a first tub 120 accommodating the first drum 110 and storing washing water or rinsing water to be used for a washing course or a rinsing course. The first tub 120 may include a first member 120*a* disposed in the front portion, and a second member 120*b* disposed in the rear portion. The first member 120*a* and the second member 120*b* of the first tub 120 may be formed by assembling them after disposing the first drum 110 therein. An engaged portion 120*c* at which the first member 120*a* and the second member 120*b* of the first tub 120 are engaged with each other may protrude from a side surface of the first tub 120.

The first drum 110 and the first tub 120 may be in the shape of a cylinder having an opening at one side, wherein the opening may face forward. More specifically, the first drum 110 may include an opening 114 into which a user can put laundry, in the front portion, and the first tub 120 may include an opening 123 into which the user can put laundry, in the front portion.

The washing machine 1 may include a housing 10 accommodating the first washing apparatus and the second washing apparatus. The housing 10 may include a first housing 130 and a second housing 230. In the washing machine 1, the first housing 130 may accommodate the first drum 110 and the first tub 120 therein. More specifically, the first housing 130 whose upper portion opens may include a pair of first side plates 131 forming both side plates of the first housing 120, a first rear plate 134 forming a rear plate of the first housing 130, and a lower plate 132 forming a bottom plate of the first housing 130. The first side plates 131 and the first rear plate 134 may be integrated into one body.

Also, the washing machine 1 may include a spring 151 and a damper 150 to support the first tub 120 on the first housing 130. The damper 150 may connect the outer surface of the first tub 120 to the lower plate 132 to support the first tub 120 from below, and a spring 151 may connect the outer surface of the first tub 120 to a spring coupling portion 133 disposed at an upper portion of the first side plates 131 to support the first tub 120 from above. The spring 151 and the damper 150 may cushion vibrations, noise, and impacts generated when the first tub 120 moves.

However, the installation positions of the spring 151 and the damper 150 may be not limited to the upper portion of the first side plate 131 and the lower plate 132, and the spring 151 and the damper 150 may connect one surface of the first tub 120 to another portion of the first housing 130, as necessary, to support the first tub 120.

The washing machine 1 may include a first driving motor 140 disposed behind the first tub 120, and configured to rotate the first drum 110. A rear surface of the first drum 110 may be connected to a first driving shaft 141 for transferring power of the first driving motor 140.

In a circumferential side of the first drum 110, a plurality of through holes 111 may be formed to pass washing water through. On an inner circumferential surface of the first drum 110, a plurality of lifters 113 may be installed so that laundry rises and falls when the first drum 110 rotates. In the front portion of the first drum 110, a first balancer 112 may be installed so that the first drum 110 can rotate stably at high speed.

The first driving shaft 141 may be disposed between the first drum 110 and the first driving motor 140. One end of the first driving shaft 141 may be connected to the rear plate of the first drum 110, and the other end of the first driving shaft 141 may extend outward from a rear wall of the first tub 120. If the first driving motor 140 drives the first driving shaft 141, the first drum 110 connected to the first driving shaft 141 may rotate with respect to the first driving shaft 141.

On the rear wall of the first tub 120, a bearing housing 142 may be installed to rotatably support the first driving shaft 141. The bearing housing 142 may be made of an aluminum alloy, and may be inserted into the rear wall of the first tub 120 when the first tub 120 is injection-molded. Between the bearing housing 142 and the first driving shaft 141, a plurality of bearings 143 may be installed to smoothly rotate the first driving shaft 141.

The washing machine 1 may have a function of washing laundry with high-temperature water. In order to acquire high-temperature water, a heater 180 for heating washing water or rinsing water accommodated in the first tub 120 may be disposed below the first tub 120.

The washing machine 1 may include a first drain pump 170 disposed below the first tub 120, and configured to discharge water inside the first tub 120 to the outside of the washing machine 1, a first connection hose 171 connecting a first outlet 173 of the first tub 120 to the first drain pump 170 so that water inside the first tub 120 can flow to the first drain pump 170, a circulation hose 174 connecting the first drain pump 170 to the first tub 120 to circulate water flowed to the first drain pump 170 to the first tub 120, and a first drain hose 172 to guide water pumped by the first drain pump 170 to the outside of the washing machine 1.

The washing machine 1 may include a front cover 40 having a first entrance 41 through which laundry can be put into the first washing space 115, and a first door 160 for opening or closing the first entrance 41 may be coupled with the front cover 40.

The first door 160 may be disposed to correspond to the first entrance 41, in such a way to rotate with respect to the front cover 40. The first door 160 may include a first door frame 161, a first door cover 162, and a door glass 163.

In the current embodiment of the present disclosure, the first door frame 161 may be in the shape of a ring, however, the first door frame 161 may be in the shape of a rectangle. The first door cover 162 and the door glass 163 may be made of a transparent material, so that the user can see the inside of the first drum 110 from the outside of the washing machine 1 when the first door 160 closes the first entrance 41. The door glass 163 may protrude convexly toward the inside of the first drum 110 from the first door frame 161. Through the structure, the door glass 163 can be inserted inward from the first entrance 41, when the first door 160 closes.

A first hinge may be disposed around the first entrance 41 so that the first door 160 can rotate with respect to the front cover 40, and the first hinge may be coupled with a first hinge coupling portion formed at one edge of the first door frame 162. At the opposite edge of the first door frame 161, a first hook 166 may be disposed, and a first hook accommodating portion 42 may be formed in the front cover 40 in correspondence to the first hook 166, so that the door 160 can be fixed when it closes the first entrance 41.

In order for the user to put laundry into the first washing space 115 when the first door 160 is in a closed state, the first door 160 may include an auxiliary laundry entrance 167, and an auxiliary door 164 for opening or closing the auxiliary laundry entrance 167. The auxiliary door 164 may be rotatably installed on the first door cover 162.

In order for the user to put laundry into the inside of the washing machine 1 through the auxiliary laundry entrance 167 of the first door 160, the laundry may need to pass through the door glass 163. For this, a glass through hole 168 may be formed in the door glass 163. Alternatively, the upper portion of the door glass 163 may be depressed so that no door glass is disposed behind the auxiliary laundry entrance 167.

In order to connect the auxiliary laundry entrance 167 of the first door 160 to the glass through hole 168 of the door glass 163, the first door 160 may include a connection guide portion 165. The connection guide portion 165 may be in the shape of a tube that opens at both ends and has a hollow area.

More specifically, one end of the connection guide portion 165 may be connected to the auxiliary laundry entrance 167, and the other end of the connection guide portion 165 may be connected to the glass through hole 168. In the current embodiment, the connection guide portion 165 may be inclined downward toward the rear direction. That is, one end of the connection guide portion 165 connected to the auxiliary laundry entrance 167 may be positioned higher than the other end of the connection guide portion 165. Through the structure, the user can easily put laundry into the inside of the first drum 110 through the auxiliary laundry entrance 167.

In the current embodiment, the auxiliary door 164 is installed in the first door 160, however, the first door 160 may include none of the auxiliary laundry entrance 167, the auxiliary door 165, and the connection guide portion 165.

The washing machine 1 may include a diaphragm 121 disposed between the first entrance 41 of the front cover 40 and the opening 123 of the first tub 120. The diaphragm 121 may form a passage arriving at the opening 114 of the first drum 110 from the first entrance 41, and may reduce vibrations transferred toward the front cover 40 when the first drum 110 rotates. A part of the diaphragm 121 may be disposed between the first door 160 and the front cover 40 to prevent washing water in the first tub 120 from leaking to the outside of the washing machine 1.

The washing machine 1 may include a second drum 210 forming a washing space 215 therein, and a second tub 220 accommodating the second drum 210 and storing washing water or rinsing water that is to be used for a washing course or a rinsing course. The second drum 210 and the second tub 220 may be in the shape of a cylinder having an opening at one side, wherein the opening may face upward.

The washing machine 1 may include a second housing 230 which accommodates the second drum 210 and the second tub 220 therein, and whose lower portion opens.

More specifically, the second housing 230 may include a lower frame 231 whose upper and lower portions open, and on which the second tub 220 is supported, and an upper frame 232 including a second entrance 234 through which the user can put laundry into the second washing space 215, the upper frame 232 mounted on the lower frame 231. Also, the second housing 230 may include a pair of side covers 233 forming the outer appearances of the left and right sides.

The washing machine 1 may include a second door 260 disposed on the second housing 230, and configured to open or close the second entrance 234. The second door 260 may be disposed to correspond to the second entrance 234, and configured to rotate with respect to the upper frame 232. The second door 260 may include a second door frame 261 and a second door cover 262. The second door cover 262 may be made of a transparent material, so that the user can see the second tub 220 and the second drum 210 from the outside of the washing machine 1 when the second door 260 closes the second entrance 234.

A second hinge may be disposed at left and right edges of the second door frame 261 so that the second door 260 can rotate with respect to the upper frame 232, and the second hinge may be coupled with a second hinge coupling portion formed around the second entrance 234. In a front edge of the second door frame 261, a latch accommodating portion 263 may be disposed, and a latch member may be disposed in the upper frame 232 to correspond to the latch accommodating portion 263 of the second door frame 261, so that the second door 260 can be fixed when it closes the second entrance 234.

The second drum 210 may be in the shape of a cylinder whose upper portion opens in such a way to be rotatable in the inside of the second tub 220. In side and bottom plates of the second drum 210, a plurality of through holes 211 may be formed to flow washing water through. In the upper portion of the second drum 210, a second balancer 212 may be installed so that the second drum 210 can rotate stably at high speed. A filter 300 may be attached on an inner side surface of the second drum 210 to filter out foreign materials generated during washing.

On the bottom of the second drum 210, a curved portion 213 may be formed to generate a water current. Although not shown in the drawings, the washing machine 1 may further include a pulsator disposed in the inside of the second drum 210 and configured to generate a water current.

The second tub 220 may be in the shape of a cylinder, and supported on the lower frame 231 by a suspension apparatus 250. More specifically, the second tub 220 may be supported in such a way to hang from the lower frame 231 by four suspension apparatuses 250. In the upper portion of the second tub 220, a third entrance 214 may be formed to correspond to the second entrance 234, and a third door 28 may be coupled with the upper portion of the second tub 220 to open or close the third entrance 214.

The third door 280 may include a third door frame 281 and a third door cover 282. The third door cover 282 may be made of a transparent material, so that the user can see the inside of the second drum 210 from the outside of the second tube 220 when the third door 280 closes the third entrance 214.

A third hinge may be disposed around the third entrance 214 so that the third door 280 can rotate with respect to the second tub 220, and the third hinge may be coupled with a third hinge coupling portion formed at one edge of the third door frame 281. At the opposite edge of the third door frame 281, a handle 283 may be disposed to open the third door 280, and a second hook 284 may be formed in the handle 283. A second hook accommodating portion may be formed in the second tub 220 in correspondence to the second hook 284, so that the third door 280 can be fixed when it closes the third entrance 214. When the handle 283 is pulled, the second hook 284 may be separated from the second hook accommodating portion to open the third door 280.

The washing machine 1 may include a second driving motor 240 disposed on the opposite surface of the bottom of the second tub 220, and configured to rotate the second drum 210. The bottom plate of the second drum 210 may be connected to a second driving shaft 241 for transferring power of the second driving motor 240. One end of the second driving shaft 241 may be connected to the bottom plate of the second drum 210, and the other end of the second driving shaft 241 may extend outward from a lower wall of the second tub 220. If the second driving motor 240 drives the second driving shaft 241, the second drum 210 connected to the second driving shaft 241 may rotate with respect to the second driving shaft 241.

Although not shown in the drawings, if the pulsator is disposed on the bottom of the second drum 210, the washing machine 1 may further include a power switch apparatus for transferring a driving force generated by the second driving motor 240 simultaneously or selectively to the second drum 210 and the pulsator.

The washing machine 1 may include a second drain pump 270 disposed below the second tub 220 to discharge water in the inside of the second tub 220 to the outside of the washing machine 1, and a second drain hose 272 to guide water pumped by the second drain pump 270 to the outside of the washing machine 1. More specifically, the second drain pump 270 may be installed in the upper portion of the first housing 130.

In the bottom of the second tub 220, a second outlet 273 may be formed to discharge water stored in the inside of the second tub 220, and the second outlet 273 may be connected to the second drain pump 270 by the second connection hose 271 to cause water stored in the second tub 220 to flow to the second drain pump 270.

The washing machine 1 may include a water supply apparatus 400 to supply washing water to the first tub 120 and the second tub 220. The water supply apparatus 400 may be installed in the second housing 230. More specifically, the water supply apparatus 400 may be disposed on the upper frame 232, and preferably, the water supply apparatus 400 may be disposed behind the second entrance 234.

Also, the washing machine 1 may include a detergent supply apparatus 500 to supply detergents to the first tub 120. The detergent supply apparatus 500 may be disposed in the second housing 230. More specifically, the detergent supply apparatus 500 may be disposed on the upper frame 232, and preferably, the detergent supply apparatus 500 may be disposed in front of the second entrance 234.

The washing machine 1 may include a fixing bracket 30 to couple the second housing 130 with the first housing 130 such that the second housing 230 is not separated from the first housing 130. The fixing bracket 30 may be coupled with the front portion of the first housing 130 and the front portion of the second housing 230.

Also, the washing machine 1 may include a control panel 50 disposed on the front cover 40 to enable the user to manipulate the washing machine 1. The control panel 50 may include an input device to receive operation commands for the washing machine 1 from the user, and a display to display operation information of the washing machine 1.

Figure 4:
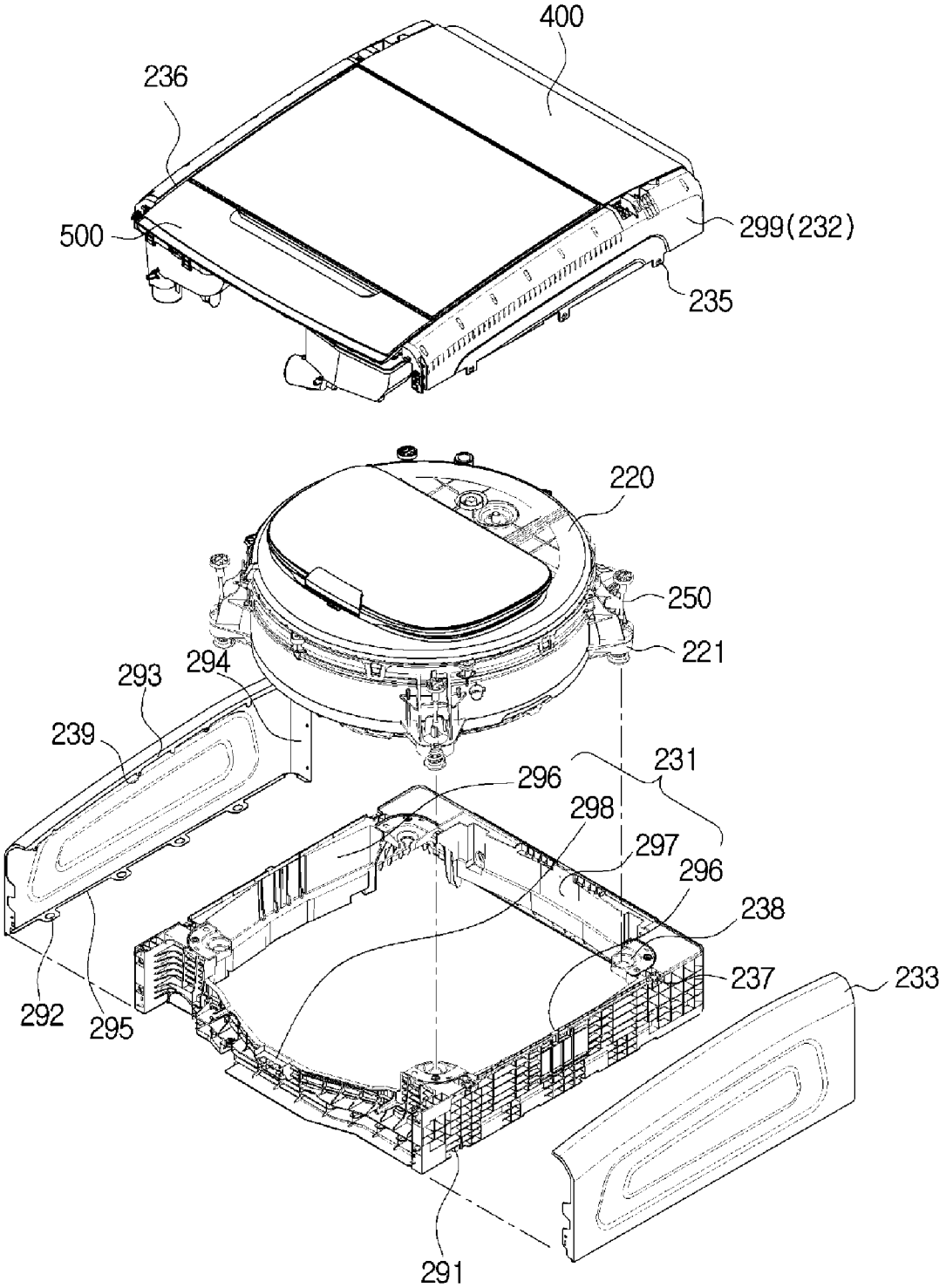
FIG. 4 is an exploded perspective view of a second housing of the washing machine shown in FIG. 2.
Figure 5:
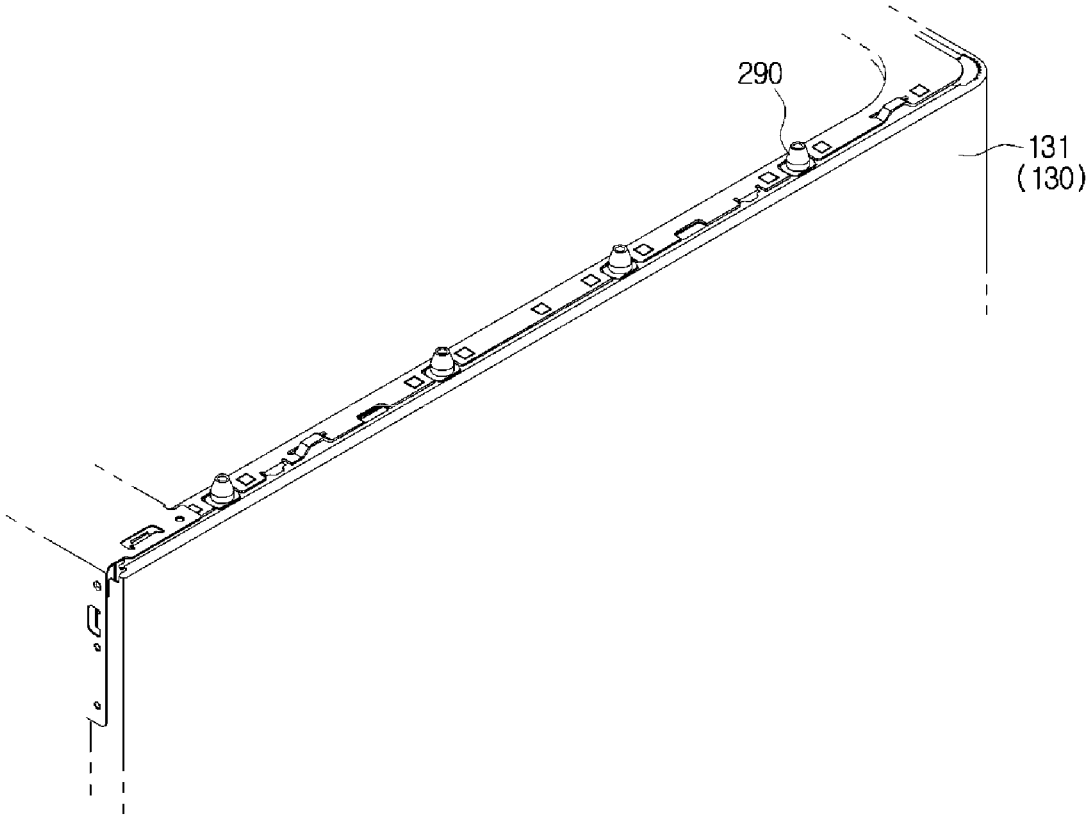
FIG. 5 is an enlarged view showing a part of a first housing of the washing machine shown in FIG. 2.
Figure 6:
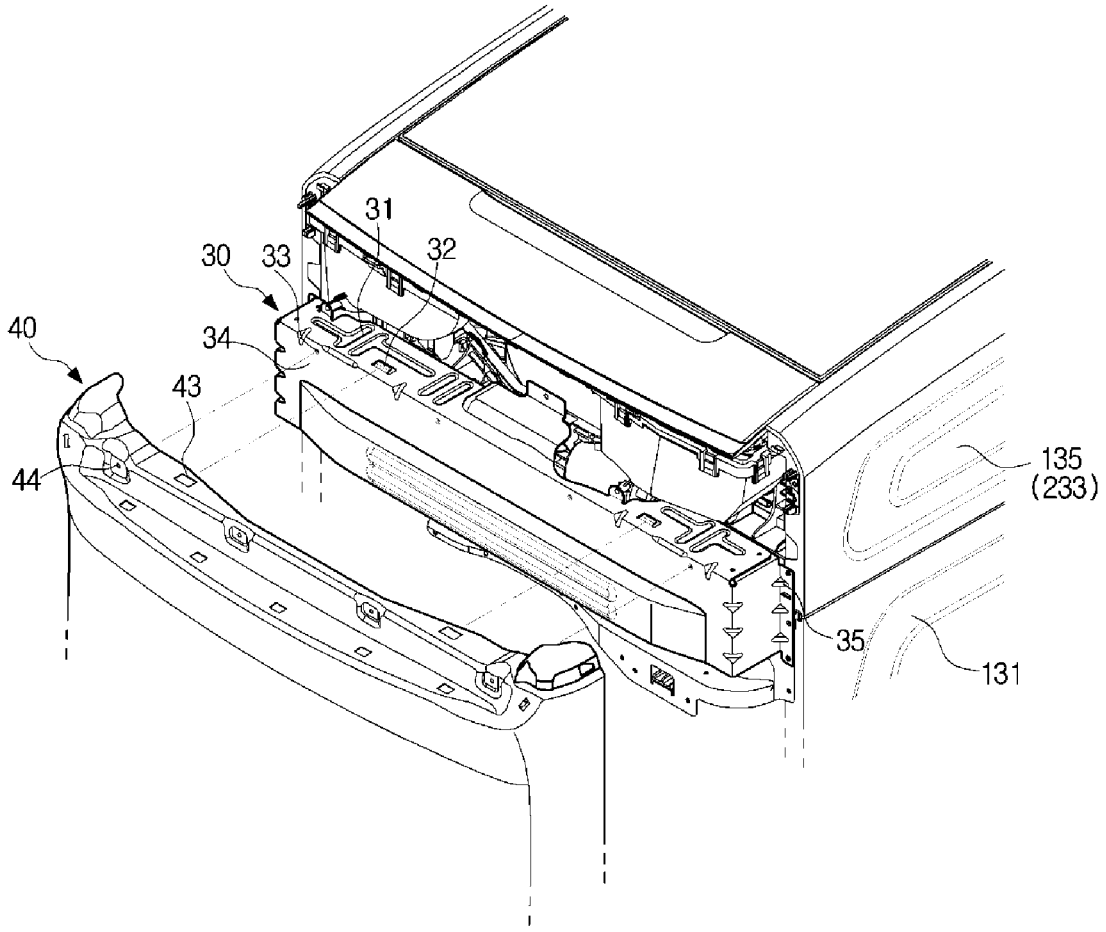
FIG. 6 is an enlarged view showing a part of a front cover and a fixing bracket of the washing machine shown in FIG. 2.
Figure 7:
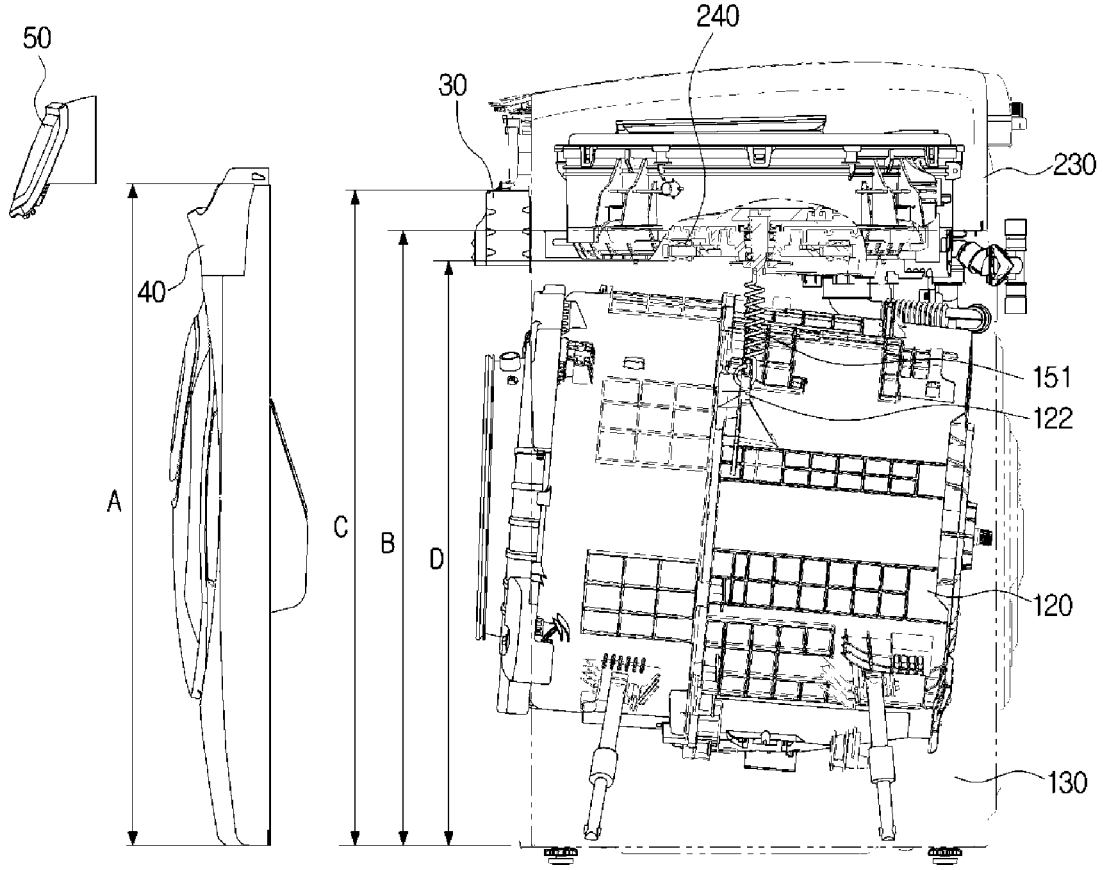
FIG. 7 is a side view showing a coupling location of the front cover and the fixing bracket of the washing machine shown in FIG. 2.

FIG. 4 is an exploded perspective view of a second housing of the washing machine shown in FIG. 2, FIG. 5 is an enlarged view showing a part of a first housing of the washing machine shown in FIG. 2, FIG. 6 is an enlarged view showing a part of a front cover and a fixing bracket of the washing machine shown in FIG. 2, and FIG. 7 is a side view showing a coupling location of the front cover and the fixing bracket of the washing machine shown in FIG. 2.

Referring to FIG. 4, the lower frame 231 of the second housing 230 may include a first support portion 238 by which the suspension apparatus 250 can be caught. Also, the second tub 220 may include a second support portion 221 in which the suspension apparatus 250 can be installed, in a lower portion of the outer side surface. The suspension apparatus 250 may connect the first support portion 238 of the lower frame 231 to the second support portion 221 of the second tub 220.

The lower frame 231 may be formed by connecting a front wall 298, a rear wall 297, and a plurality of side walls 296 to surround the front, rear, and side portions of the second tub 220. The first support portion 238 may be disposed at the upper end of each corner of the lower frame 231, so that the lower frame 231 can have sufficient stiffness capable of supporting the second tub 220 by the four suspension apparatuses 250.

The upper frame 232 may include a first coupling portion 235 to couple with the lower frame 231. First coupling portions 235 may be respectively disposed at lower ends of left and right sides of the upper frame 232. The lower frame 231 may include a second coupling portion 237 to couple with the upper frame 232. Second coupling portions 237 may be respectively disposed to correspond to the first coupling portions 235 of the upper frame 232, at the upper ends of the lower frame 231.

The side covers 233 may be coupled with the upper frame 232 and the lower frame 231 to cover the side surface of the upper frame 232 and the side surface of the lower frame 231. Each side cover 233 may include an upper-end flange 293 that is coupled with the upper frame 232, and the upper frame 232 may include a coupling groove 236 into which the upper-end flange 293 of the side cover 233 can be inserted. In the upper-end flange 293 of the side cover 233, a coupling portion 239 may be formed to be coupled with the upper frame 232 in the inside of the coupling groove 236 of the upper frame 232. The coupling portion 239 may be coupled with the upper frame 232 by a coupling member such as a screw.

In the lower end of the side cover 233, a lower-end flange 295 may be formed to surround a part of the lower surface of the lower frame 231. In the rear end of the side cover 233, a rear-end flange 294 may be formed to surround parts of the rear surfaces of the upper frame 232 and the lower frame 231.

After the lower frame 231 is coupled with the upper frame 232, the upper-end flange 293 of the side cover 233 may be inserted into the coupling groove 236 of the upper frame 236, and then the side cover 233 may rotate to locate the lower-end flange 295 of the side cover 233 on the bottom of the lower frame 231, thereby being coupled with the lower frame 231. After the side covers 233 are coupled, the rear-end flanges 294 of the side covers 233 may be fixed on the rear surfaces of the upper frame 232 and the lower frame 231 by a coupling member such as a screw.

In the lower frame 231, vibrations may be generated by the second tub 220 supported on the lower frame 231. Also, by coupling of the lower frame 231 and the upper frame 232, vibrations of the lower frame 231 may be transferred to the upper frame 232.

When the lower frame 231 and the upper frame 232 are disassembled by vibrations, etc., the side covers 233 may prevent the lower frame 231 and the upper frame 232 from being separated, thereby preventing the user's injury. Also, the side covers 233 may cover the left and right side surfaces of the lower frame 231 and the upper frame 232 with a single member, thereby simplifying the side surfaces of the second housing 230. Also, the side covers 233 may make the first housing 130 and the second housing 230 have a unified esthetic sense after the second housing 230 is coupled with the first housing 130.

Referring to FIGS. 4 and 6, the second housing 230 of the washing machine 1 may include a pair of second side plates 135 forming the side surfaces of the second housing 230. That is, the second side plates 135 of the second housing 230 may be configured with at least one part of the side walls 296 of the lower frame 231, the side walls 299 of the upper frame 232, and the side covers 233.

Referring to FIG. 5, the washing machine 1 may include a first guide protrusion 290 disposed on the upper end of the first housing 130 to guide a resting position of the second housing 230. More specifically, the first guide protrusion 290 may protrude upward from the pair of first side plates 131. The first guide protrusion 290 may be formed as a separate member and then coupled with the first side plates 131, or the first guide protrusion 290 may be integrated into the first side plates 131.

Referring to FIG. 4, the washing machine 1 may include a guide protrusion inserting portion formed in the bottoms of the pair of second side plates 135 of the second housing 230 so that the first guide protrusion 290 is inserted into the guide protrusion inserting portion. More specifically, in the lower-end flange 295 of the side cover 233 forming the second side plate 135, a through hole 292 may be formed to pass the first guide protrusion 290 through, and a guide protrusion accommodating portion 290 may be formed in the bottom of the side wall 296 of the lower frame 231 forming the second side plate 135 to accommodate the first guide protrusion 290.

Four first guide protrusions 290 may be disposed at each of the left and right upper ends of the first side plates 131 of the first housing 130, and the side surface of the second housing 230 can be aligned with the side surface of the first housing 130 without making any step by the first guide protrusions 290.

Although not shown in the drawings, the guide protrusions 290 for guiding the resting position of the second housing 230 may protrude downward from the pair of second side plates 135 of the second housing 230, or the guide protrusion inserting portions into which the guide protrusions 290 are inserted may be formed in the upper ends of the pair of first side plates 131 of the first housing 130.

Referring to FIGS. 6 and 7, the front cover 40 may cover at least one part of the front surface of the first housing 130 and at least one part of the front surface of the second housing 230. In the drawings, the front cover 40 is shown to cover the entire front surface of the first housing 130, however, the front cover 40 may cover a part of the front surface of the first housing 130 and a part of the front surface of the second housing 230.

The fixing bracket 30 may be disposed in the inside of the front cover 40, and fix the first housing 130 and the second housing 230 in front of the first housing 130 and the second housing 230. More specifically, the fixing bracket 30 may connect the pair of first side plates 131 of the first housing 130 to the pair of second side plates 135 of the second housing 230.

The fixing bracket 30 may be in the shape of a rectangular parallelepiped having a length corresponding to a width in left-right direction of the first housing 130 and the second housing 230, and having a thickness corresponding to the thickness of the front cover 40. The fixing bracket 30 may have a front surface 34, a top surface 31, a left surface, and a right surface, wherein rear and bottom portions of the fixing bracket 30 may open.

The fixing bracket 30 may include a coupling flange 35 that can be coupled with the front portion of the first housing 130 and the front portion of the second housing 230. More specifically, the coupling flange 35 of the fixing bracket 30 may be coupled with front ends of the pair of first side plates 131 of the first housing 130 and front ends of the pair of second side plates 135 of the second housing 230 by a coupling member such as a screw.

The fixing bracket 30 may include a second guide protrusion 32 disposed on the top surface 31 of the fixing bracket 30 to guide a coupling position of the front cover 40. The front cover 40 may include a guide hole 43 which is formed in the top portion of the front cover 40 and with which the second guide protrusion 32 of the fixing bracket 30 can be coupled.

Also, the fixing bracket 30 may include a third coupling portion 33 which is disposed on the front surface 34 of the fixing bracket 30 and with which the front cover 40 can be coupled. The front cover 40 may include a fourth coupling portion 44 formed in the upper portion of the front cover 40 to correspond to the third coupling portion 33 of the fixing bracket 30.

When the front cover 40 is assembled, the front cover 40 may be temporarily coupled with the fixing bracket 30 by causing the second guide protrusion 32 of the fixing bracket 30 to pass through the guide hole 43 of the front cover 40, and then the third coupling portion 33 of the fixing bracket 30 may be coupled with the fourth coupling portion 44 of the front cover 40 by a coupling member such as a screw.

Referring to FIGS. 2 and 7, the first tub 120 may be supported on the first housing 130 by the spring 151. More specifically, one end of the spring 151 may be coupled with the first spring coupling portion 133 disposed at the upper portion of the first side plate 131 of the first housing 130, and the other end of the spring 151 may be coupled with a second spring coupling portion 122 formed on the outer side surface of the first tub 120. The spring 151 may reduce vibrations and noise of the first tub 120, and vibrations of the first tub 120 may be transferred to the first housing 130 by the spring 151.

A height A of the top end of the front cover 40 may be higher than a height B of the top end of the first housing 130 with which the spring 151 is coupled, thereby ensuring stiffness for supporting the front portion of the washing machine 1, while efficiently preventing vibrations of the first housing 130 and the second housing 230 from being transferred in the front direction. Also, the front surface of the washing machine 1 can be configured with only the front cover 40 and the control panel 50 disposed in the upper portion of the front cover 40, thereby providing an esthetic effect.

A height C of the top end of the fixing bracket 30 may be preferably higher than or equal to a height D of the top end of the second driving motor 240 disposed on the opposite surface of the bottom of the second tub 220. Since the fixing bracket 30 may include a fire-resistant material such as a metal, and is disposed to be higher than the second driving motor 240, the fixing bracket 30 can prevent, when a fire breaks out by overheating of the second driving motor 240, the fire from spreading toward the front panel 40 or the control panel 50.

Figure 8:
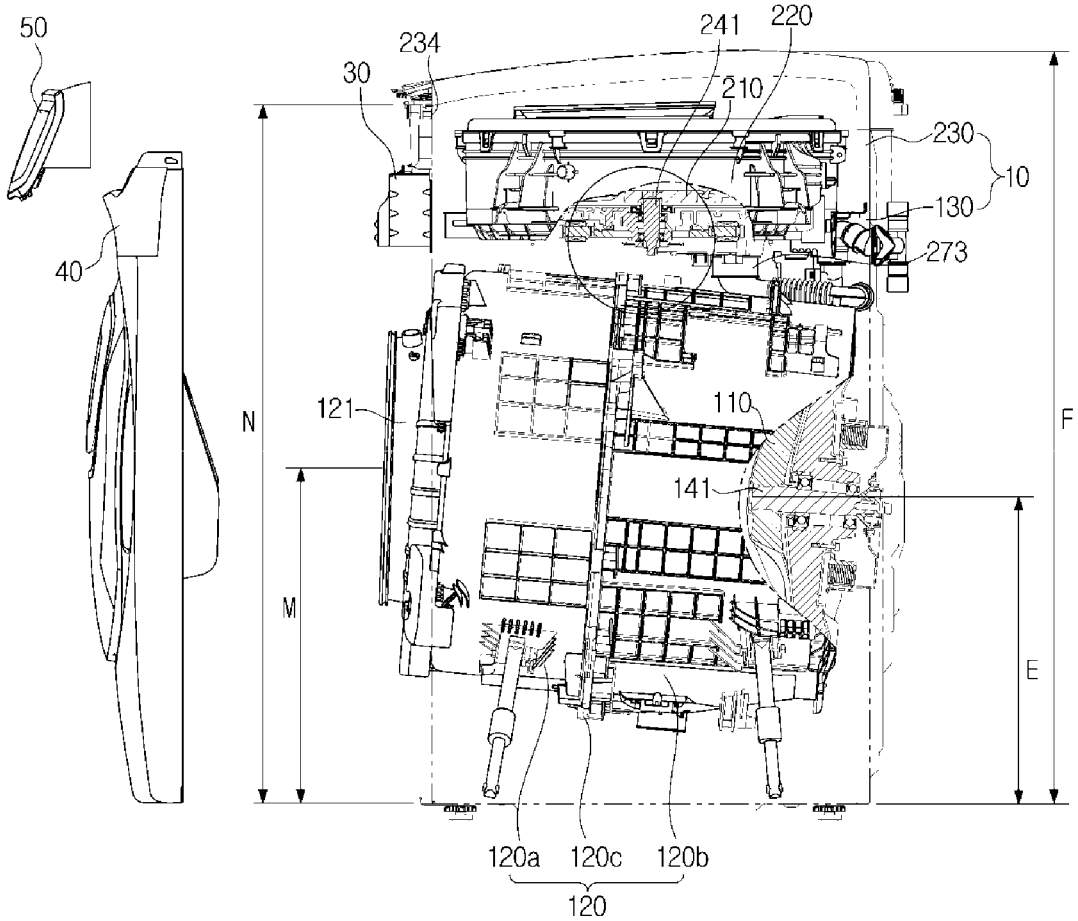
FIG. 8 is a side view showing positions of a first tub and a second tub of the washing machine shown in FIG. 2.
Figure 9:
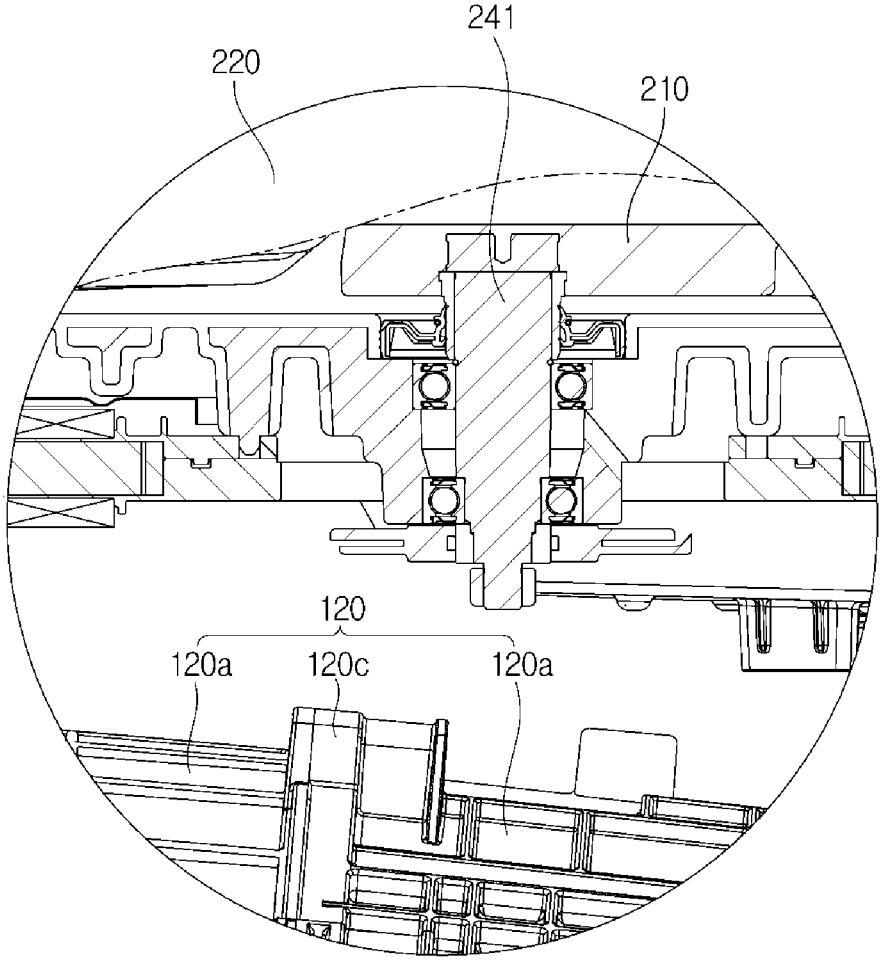
FIG. 9 is an enlarged view showing a part of the first tub and the second tub of the washing machine shown in FIG. 8.

FIG. 8 is a side view showing positions of a first tub and a second tub of the washing machine shown in FIG. 2, and FIG. 9 is an enlarged view showing a part of the first tub and the second tub of the washing machine shown in FIG. 8.

Referring to FIG. 8, the second tub 220 having the second entrance 234 to enable a user to put laundry in the upper portion may be disposed above the first tub 120 having the first entrance 41 to enable the user to put laundry in the front portion. It is advantageous that the second tub 220 is disposed close to the first tub 120 in order to lower the height of the housing 10 and to efficiently use the inside space of the housing 10. However, if the second tub 220 is too close to the first tub 120, a collision and noise may be generated by vibrations when the washing machine 1 operates.

The first tub 120 may be in the shape of a cylinder having a first opening in at least one part of one of two facing sides, wherein the first opening may face forward.

The first tub 120 may be inclined upward toward the front portion, for the user's convenience. That is, the first tub 120 may be inclined downward from the front portion to the rear portion. The first tub 120 may be inclined upward at about 5 degrees toward the front portion.

The second tub 220 may be in the shape of a cylinder having a second opening in at least one part of one of two facing sides, wherein the second opening may face upward.

In the bottom of the second tub 220, the second outlet 273 may be formed. The second outlet 273 may be disposed in the rear portion of the second tub 220 or in the left or right portion of the second tub 220. Since a vertical distance between a bottom **220*b* of the second tub 220 and the first tub 120 increases in the rear direction and in both side directions, the second outlet 273 may extend further down than the uppermost end of the first tub 120**.

The first drum 110 may be disposed in the inside of the first tub 120. The first drum 110 may form the first washing space 115 (see FIG. 1). The first drum 110 may be in the shape of a cylinder having an opening in at least one part of one of two facing sides, wherein the opening may face forward.

The first driving shaft 141 to transfer a driving force to the first drum 110 to rotate the first drum 110 may be connected to the other one of the two facing sides of the first drum 110. The first driving shaft 141 may penetrate the first tub 120 to be connected to the rear surface of the first drum 110. The first driving shaft 141 may be connected to the center of the rear surface of the first drum 110. As a height E from the bottom of the housing 10 to the first driving shaft 141 is higher, the first washing space 115 of the first drum 110 may become wider. That is, as the height E from the bottom of the housing 10 to the center of the rear surface of the first drum 110 is higher, the first washing space 115 of the first drum 110 may become wider.

The first entrance 41 (see FIG. 1) through which laundry is put in the first washing space 115 may be formed in front of the first washing space 115. The first entrance 41 may correspond to the diaphragm 121 disposed between the first entrance 41 and the opening of the first tub 120. As the height E from the bottom of the housing 10 to the first driving shaft 141 is higher, the height of the first entrance 41 may also become higher, resulting in an improvement of a user's convenience.

The first drum 110 may be inclined upward toward the front portion, for the user's convenience. Likewise, the first driving shaft 141 may be inclined upward toward the front portion. Since a height M of the center of the first entrance 41 is higher than the height E of the center of the rear surface of the drum 110, the user's convenience can be improved. The center of the first entrance 41 may be identical to the center of the diaphragm 121.

The second drum 210 may be disposed in the inside of the second tub 220. The second drum 210 may form the second washing space 215 (see FIG. 1). The second drum 210 may be in the shape of a cylinder having an opening in at least one part of one of two facing sides, wherein the opening may open upward.

The second driving shaft 241 to transfer a driving force to the second drum 210 to rotate the second drum 210 may be connected to the other one of the two facing sides of the second drum 210. The second driving shaft 241 may penetrate the second tub 220 to be connected to the bottom of the second drum 210.

Referring to FIGS. 8 and 9, the second driving shaft 241 may protrude below the second tub 220. The engaged portion 120*c* of the first member 120*a* and the second member 120*b* forming the first tub 120 may protrude from the side surface of the first tub 120.

The second driving shaft 241 may be located further behind than the engaged portion 120*c* of the first member 120*a* and the second member 120*b* of the first tub 120. Since the second tub 220 and the second drum 210 are disposed such that the second driving shaft 241 is located further behind than the engaged portion 120*c* of the first tub 120, it is possible to prevent the second driving shaft 241 from colliding with the first tub 120, while disposing the second tub 220 close to the first tub 120.

The second entrance 234 through which laundry is put into the second washing space 215 may be formed in the upper portion of the second washing space 215. As a height F from the bottom of the housing 10 to the top end of the housing 10 is higher, the second washing space 215 of the second drum 210 may become wider. However, as the height F of the housing 10 is higher, a height N from the bottom of the housing 10 to the second entrance 234 may also become higher, which may lead to the user's inconvenience.

In order for the first drum 110 to have an appropriate capacity while maintaining the height F of the housing 10 at an appropriate level, a ratio E/F of the height E of the first driving shaft 141 to the height F of the housing 10 may be 0.3 or more. That is, a distance from the lowermost end of the housing 10 to the center of the rear surface of the first drum 110 may be 0.3 times or more of a distance from the lowermost end of the housing 10 to the uppermost end of the housing 10.

The housing 10 may include the second door 260 to open or close the second entrance 234 through which laundry can be put into the inside of the second drum 210 or the second tub 220. The uppermost end of the housing 10 may be the uppermost end of the door 290.

If the ratio E/F of the height E of the first driving shaft 141 to the height F of the housing 10 is greater than 0.5, a space in which the second drum 210 can be disposed in the inside of the housing 10 may be narrowed. In order for the second drum 210 to have an appropriate capacity while maintaining the height F of the housing 10 at an appropriate level, the ratio E/F of the height E of the first driving shaft 141 to the height F of the housing 10 may be 0.5 or less. That is, the distance from the lowermost end of the housing 10 to the center of the rear surface of the first drum 110 may be 0.5 times or less of a distance from the lowermost end of the housing 10 to the uppermost end of the housing 10.

The ratio E/F of the height E of the first driving shaft 141 to the height F of the housing 10 may be 0.4, in consideration of the height F of the housing 10, the size of the first drum 110, and the size of the second drum 210.

The first drum 110 and the first tub 120 may be inclined upward toward the front portions, so that the height M of the center of the first entrance 41 may become higher than the height E of the center of the rear surface of the first drum 110. For the user's convenience, the height N of the second entrance 234 may be lower than the height F of the upper end of the housing 10 from the bottom of the housing 10. Therefore, the ratio E/F of the height E of the first driving shaft 141 to the height F of the housing 10 may be smaller than a ratio M/N of the height M of the center of the first entrance 41 to a height N of the second entrance 234.

Since the washing machine according to the present disclosure has a plurality of washing apparatuses, a user can sort laundry and wash the laundry separately through the washing machine, as necessary.

The washing machine according to the present disclosure can efficiently use the inside space of the housing, which contributes to an improvement of a user's convenience.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a first housing;

a first tub accommodated in the first housing, formed by assembling a first member disposed in a front portion thereof with a second member disposed in a rear portion thereof, and including a first opening provided in the front portion and through which laundry is put;

a second housing;

a second tub accommodated in the second housing, and including a second opening provided in an upper portion thereof and through which laundry is put;

a fixing bracket to couple the first housing and the second housing by coupling a pair of sides of the first housing with a pair of sides the second housing, respectively;

a first drum rotatably disposed in inside of the first tub;

a second drum rotatably disposed in inside of the second tub; and a driving motor to generate a driving force to rotate the second drum;

a driving shaft connected to the second drum, and configured to transfer the generated driving force to the second drum, the driving shaft penetrating the second tub, wherein the second tub is disposed above the first tub, and the driving shaft is located further behind than an engaged portion of the first member and the second member of the first tub, the engaged portion being where the first member and the second member are engaged together.

2. The washing machine according to claim 1, wherein the first tub is inclined downward from the front portion to the rear portion, the engaged portion of the first tub protrudes from a side surface of the first tub, and the driving shaft protrudes below the second tub.

3. The washing machine according to claim 1, wherein a distance from a lowermost end of the first housing to a center of a rear surface of the first drum is about 0.3 times or more of a distance from the lowermost end of the first housing to an uppermost end of the second housing.

4. The washing machine according to claim 1, wherein a distance from a lowermost end of the first housing to a center of a rear surface of the first drum is about 0.5 times or less of a distance from the lowermost end of the first housing to an uppermost end of the second housing.

5. The washing machine according to claim 1, wherein the second housing comprises a door configured to open or close the second opening, and an uppermost end of the second housing is an uppermost end of the door.

6. The washing machine according to claim 1, wherein each of the pair of sides of the first housing includes a first front end and each of the pair of sides of the second housing includes a second front end, and the fixing bracket couples the first housing with the second housing by coupling the first front end with the second front end, respectively.

7. The washing machine according to claim 6, wherein the fixing bracket includes coupling flanges to be coupled with the first front end and the second front end, respectively by fastening members.

8. A washing machine comprising:

a first housing;

a first tub disposed in the first housing, and configured to store water;

a first drum rotatably disposed in inside of the first tub;

a second housing;

a second tub disposed above the first tub in the second housing, and configured to store water;

a second drum rotatably disposed in inside of the second tub;

a fixing bracket to couple the first housing and the second housing by coupling a pair of sides of the first housing with a pair of sides the second housing together, respectively;

a driving motor to generate a driving force to rotate the second drum; and a driving shaft connected to the second drum, and configured to transfer the generated driving force to the second drum, wherein the first tub is inclined downward from a front portion thereof to a rear portion thereof, and the driving shaft protrudes below the second tub.

9. The washing machine according to claim 8, wherein the first tub is formed by assembling a first member disposed in the front portion with a second member disposed in the rear portion, and the driving shaft is located further behind than an engaged portion of the first member and the second member of the first tub, the engaged portion being where the first member and the second member are engaged together.

10. The washing machine according to claim 8, wherein a distance from a lowermost end of the first housing to a center of a rear surface of the first drum is about 0.3 times or more of a distance from the lowermost end of the first housing to an uppermost end of the second housing.

11. The washing machine according to claim 10, wherein the second housing comprises a second opening through which laundry is put into the inside of the second drum, and a door configured to open or close the second opening, and wherein the uppermost end of the second housing is the uppermost end of the door.

12. The washing machine according to claim 8, wherein a distance from a lowermost end of the first housing to a center of a rear surface of the first drum is about 0.5 times or less of a distance from the lowermost end of the first housing to an uppermost end of the second housing.

13. The washing machine according to claim 8, wherein each of the pair of sides of the first housing includes a first front end and each of the pair of sides of the second housing includes a second front end, and the fixing bracket couples the first housing with the second housing by coupling the first front end with the second front end, respectively.

14. The washing machine according to claim 13, wherein the fixing bracket includes coupling flanges to be coupled with the first front end and the second front end, respectively by fastening members.

15. A washing machine comprising:

a first housing having an open upper portion;

a first tub disposed in the first housing, and configured to store water;

a first drum rotatably disposed in the first tub;

a second housing coupled with the upper portion of the first housing, the second housing having an open lower portion;

a second tub disposed in the second housing, and configured to store water;

a second drum rotatably disposed in the second tub;

a fixing bracket to couple the first housing and the second housing by coupling a pair of sides of the first housing with a pair of sides the second housing together, respectively;

a driving motor to generate a driving force to rotate the second drum; and a driving shaft connected to the second drum, and configured to provide the generated driving force to the second drum, the driving shaft penetrating the second tub, wherein the first housing comprises a first opening through which laundry is put into inside of the first drum from front, the second housing comprises a second opening through which laundry is put into inside of the second drum from above, the first tub is formed by assembling a first member disposed in a front portion with a second member disposed in a rear portion, the first tub inclined downward from the front portion to the rear portion, and the driving shaft is located further behind than an engaged portion of the first member and the second member of the first tub, the engaged portion being where the first member and the second member are engaged together.

16. The washing machine according to claim 15, wherein each of the pair of sides of the first housing includes a first front end and each of the pair of sides of the second housing includes a second front end, and the fixing bracket couples the first housing with the second housing by coupling the first front end with the second front end, respectively.

17. The washing machine according to claim 16, wherein the fixing bracket includes coupling flanges to be coupled with the first front end and the second front end, respectively by fastening members.

* * * * *